US006676332B1

(12) United States Patent
Hauer et al.

(10) Patent No.: US 6,676,332 B1
(45) Date of Patent: Jan. 13, 2004

(54) HIGHWAY DEVICE AND COVERING ELEMENT FOR SUCH A DEVICE

(75) Inventors: Jean-Claude Hauer, Saulxures lès Nancy (FR); Jean-Paul Pietrzak, Blenod lès Pont à Mousson (FR)

(73) Assignee: Saint Gobain Pam, Nancy (FR)

( * ) Notice: Subject to any disclaimer, the term of this patent is extended or adjusted under 35 U.S.C. 154(b) by 0 days.

(21) Appl. No.: 09/959,374

(22) PCT Filed: Apr. 20, 2000

(86) PCT No.: PCT/FR00/01033

§ 371 (c)(1), (2), (4) Date: Mar. 11, 2002

(87) PCT Pub. No.: WO00/68517

PCT Pub. Date: Nov. 16, 2000

(30) Foreign Application Priority Data

May 5, 1999 (FR) ..... 99 05717

(51) Int. Cl.[7] ..... E02D 29/14
(52) U.S. Cl. ..... 404/25; 52/20
(58) Field of Search ..... 404/25, 62; 52/19, 52/20, 21

(56) References Cited

U.S. PATENT DOCUMENTS 4,592,674 A * 6/1986 Baliva ..... 404/25
4,840,514 A * 6/1989 Defrance et al. ..... 404/25
5,362,174 A * 11/1994 Yang ..... 404/25

FOREIGN PATENT DOCUMENTS

| | | | |
|---|---|---|---|
| EP | 0451064 A1 * 3/1991 | ..... | E02D/29/14 |
| EP | 0551046 A1 * 12/1992 | ..... | E02D/29/14 |
| FR | 2688528 * 3/1992 | ..... | E02D/29/14 |
| GB | 529826 * 11/1940 | | |

* cited by examiner

*Primary Examiner*—Robert E. Pezzuto
*Assistant Examiner*—Alexandra K. Pechhold
(74) *Attorney, Agent, or Firm*—Sughrue Mion, PLLC

(57) ABSTRACT

This highway device includes a frame and an element (14) for covering the frame, the frame (12) including a peripheral border with two walls delimiting a groove and the covering element being equipped with a projecting peripheral lip (32) engaging in the groove in the frame-covering position. The covering element (14) includes at least one ramp (44) extending between the lip (32) and the internal surface of the element, the ramp or ramps being intended to bear on the end edge of the peripheral border of the frame and thus guiding the covering element during the displacement of the latter with respect to the frame, under the action of a force exerted on the element in a zone opposite the ramp or ramps (44).

14 Claims, 3 Drawing Sheets

HIGHWAY DEVICE AND COVERING ELEMENT FOR SUCH A DEVICE

BACKGROUND OF THE INVENTION

The present invention relates to a highway device, and also to a covering element for such a device.

It concerns in particular a device for closing inspection shafts of an underground network, such as roadway or footway manholes, or a device for capping drains, such as a highway grate.

Highway devices of this type are generally equipped with a frame and an element for covering the frame.

The invention concerns in particular a device of this type, in which the frame comprises an upstanding peripheral border with two walls delimiting a groove and in which the covering element, for its part, is equipped with a projecting peripheral lip.

In the closed position, the covering element caps the frame so that the lip engages in the groove.

In general, in order to remove the covering element, often produced in cast iron, it is necessary to lift it vertically so as to disengage the lip from the groove, this presenting a major disadvantage in view of its mass.

The document FR-A-2 531 152 proposes solving this problem by providing the bottom of the groove with an inclined ramp allowing translation of the covering element during its removal from or mounting on the frame. However, such a solution does not allow, with less effort, the opening and/or closure of the covering element by rotation about the frame.

Another solution consists in equipping the bottom of the groove with a guide allowing rotational guidance of the covering element about a horizontal axis, but this solution does not then allow translation of the covering element during its removal.

These technical solutions thus do not allow displacement of the covering element either rotationally or translationally.

SUMMARY OF THE INVENTION

In the light of the foregoing, the object of the invention is to provide a highway device, the covering element of which can be manipulated easily, either translationally or rotationally, as desired.

The subject of the invention is therefore a highway device of the above-mentioned type, characterized in that the covering element comprises at least one ramp extending between the lip and the internal surface of the said element, the ramp or ramps being intended to bear on the end edge of the peripheral border of the frame and thus constituting a means for guiding the covering element during the displacement of the latter with respect to the frame, under the action of a force exerted on the said element in a zone opposite the ramp or ramps.

In various embodiments, the highway device according to the invention comprises one or more of the following features, considered in isolation or in any technically possible combination.

- the ramp or ramps have a sagittal section in the shape of a sector of a disc;
- the free end edge of the lip comprises a chamfer constituting a stop for limiting the rotation of the covering element in the direction of opening, in conjunction with the free end zone of the external wall of the frame, on which the external surface of the covering element butts;

- the covering element is equipped with grasping means situated opposite the ramp or ramps;
- the grasping means consist of a cutout formed in the external surface of the covering element;
- the grasping means consist of a through-orifice formed in the wall of the covering element in a zone situated between the border of the latter and the lip;
- the lip forms, in the said zone, an offset;
- it comprises a lock for locking the covering element in the closed position, on the frame;
- the lock comprises a pivoting rod secured to a locking bar by means of two end limbs capable of being folded back, the said bar being intended to be inserted beneath a stop of the frame;
- it comprises a seal interposed between the lock and the covering element;
- the groove is filled with water and forms, in conjunction with the lip of the covering element, an odour trap;
- the frame comprises, at its base, at least one laterally projecting relief, the lower face of which is provided with a series of ribs for anchoring the device in an embedding material; and
- the frame comprises anchoring ribs made in the median part of each of its sides, the said ribs being adapted to oppose the bending of the frame.

The subject of the invention is also a covering element for closing an inspection shaft or capping a drainage shaft, comprising a projecting peripheral lip intended to engage in a groove of a support frame, the said groove being delimited by a peripheral border of the frame with two walls, characterized in that the covering element comprises at least one ramp extending between the lip and the internal surface of the covering element and being intended to bear on the end edge of the peripheral border of the frame in order thus to constitute a means for guiding the covering element during the displacement of the latter with respect to the frame under the action of a force exerted on the said element in a zone opposite the ramp.

BRIEF DESCRIPTION OF THE DRAWINGS

Other features and advantages will become apparent from the description which follows, given purely by way of example and with reference to the accompanying drawings, in which.

DETAILED DESCRIPTION OF THE ILLUSTRATIVE EMBODIMENTS

Figure 1:
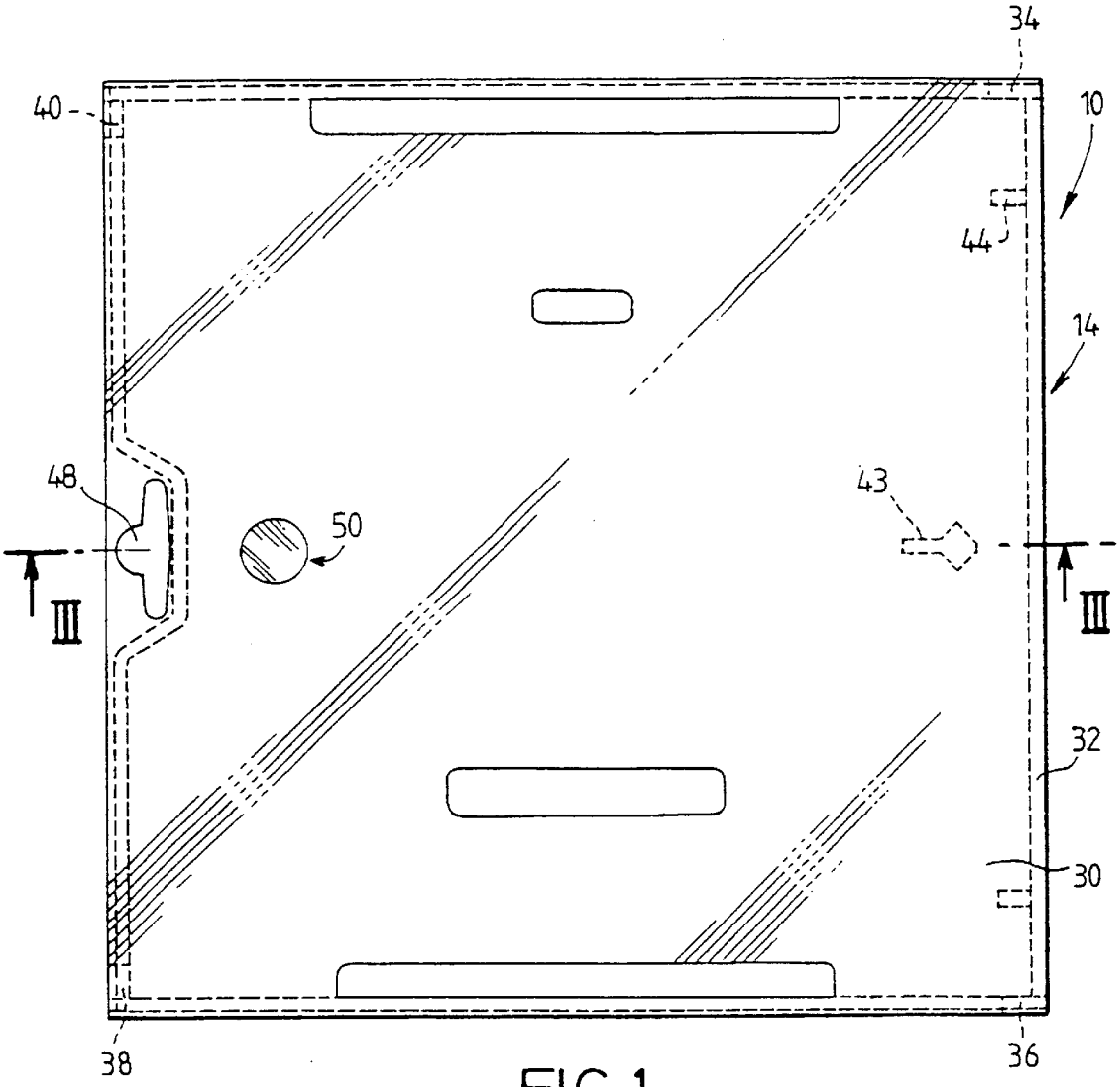
FIG. 1 is a top view of the covering element of a highway device according to the invention.
Figure 2:
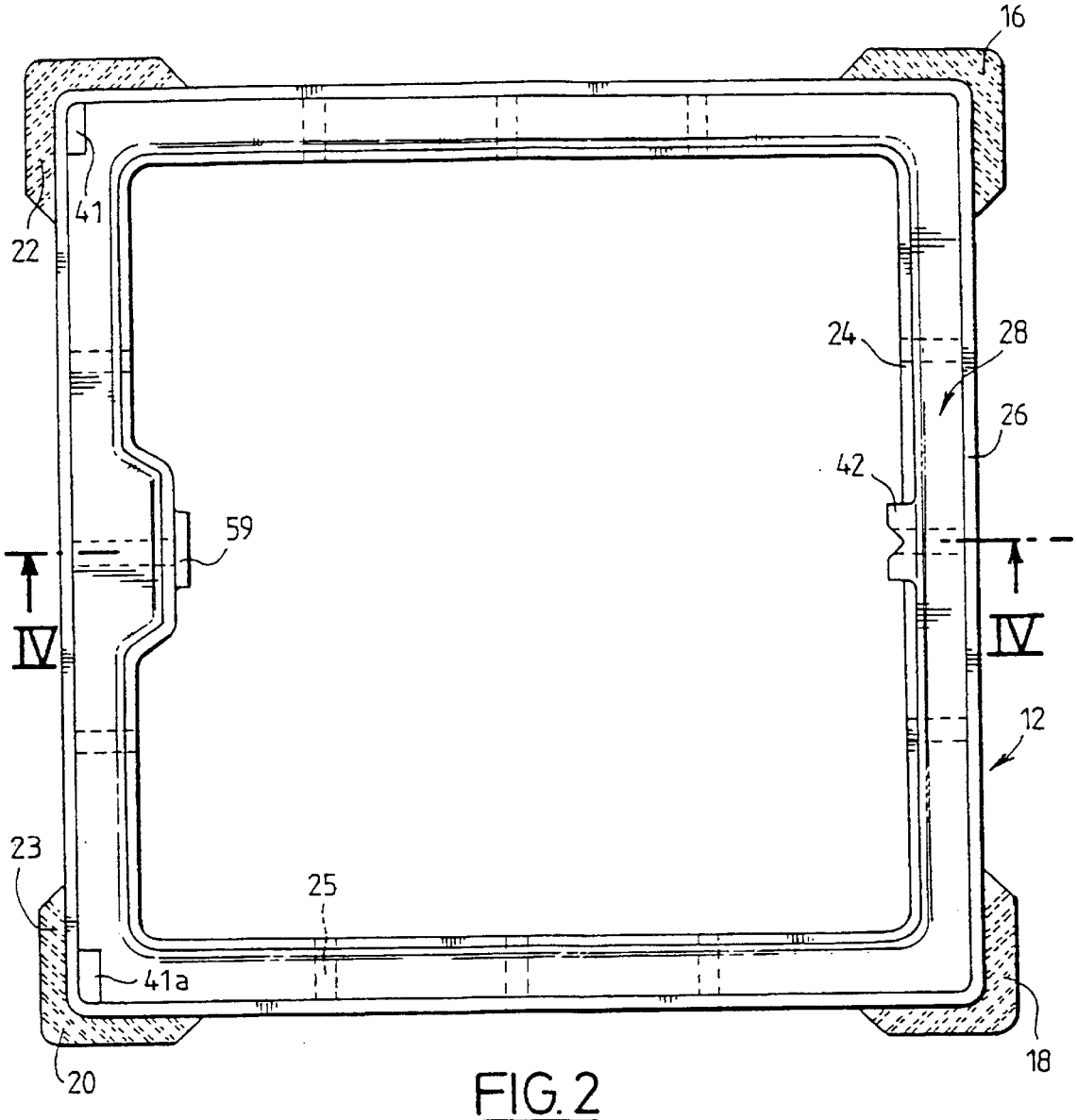
FIG. 2 is a top view of the frame of the device according to the invention.
Figure 4:
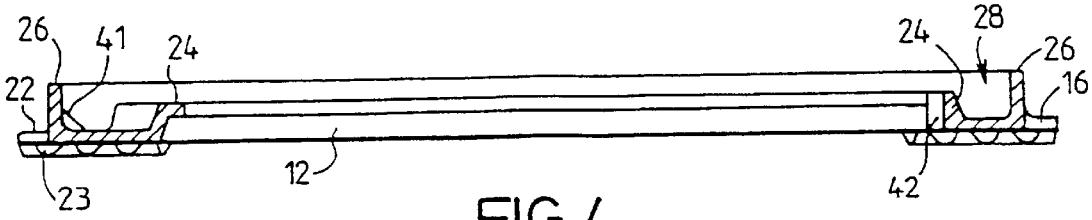
FIG. 4 is a sectional view along the line IV—IV of the frame of FIG. 2.

FIGS. 1 and 2 show a top view of the constituent elements of a highway device, denoted by the general reference numeral 10.

It is produced in particular in cast iron and has a rectangular or square section in cross-section.

In the exemplary embodiment shown, it is intended for closing an inspection shaft of an underground network.

The device 10 comprises a frame 12 forming a base, which is intended to be mounted on the shaft for access to the underground network, and a covering element 14 consisting of a cover, which caps the frame.

The frame 12 comprises, in each corner, a relief 16, 18, 20 and 22 projecting laterally from the wall constituting the frame 12 in order to improve the vertical anchorage of the frame in an embedding material, in this instance mortar, and in order to avoid rotation of the frame about a vertical axis when it is subjected to a rotational force. A series of ribs, such as 23, extend diagonally on the lower face of each relief in order to improve the horizontal anchorage of the device in the embedding material.

Additional anchoring ribs such as 25 are provided beneath the frame in the median zones in order to prevent the frame 12 from bending in the event of deficient embedding.

The frame 12 comprises an upstanding peripheral border with two substantially vertical walls 24, 26 delimiting between them a generally U-shaped groove 28. The height of the inner wall 24 is lower than that of the outer wall 26.

The cover 14, for its part, mainly consists of a flat plate 30, solid or apertured, which is equipped with a peripheral lip 32 projecting from the internal or lower surface of the plate 30. The cover comprises a first set of bearing blocks 34, 36 configured in the form of a plane bearing surface coplanar with the plate 30, and also a second set of bearing blocks 38, 40 situated opposite the first set and configured in the form of a bearing surface extending in an inclined manner with respect to the plane of the plate 30 downwards and in the direction of the plane bearing surfaces 34 and 36 opposite.

In the assembled state, that is to say when the cover 14 is resting on the frame 12, the peripheral lip 32 engages in the groove 28 and rests by the bearing blocks 34, 36 on the bottom of the groove, whereas the bearing blocks 38 and 40 of the second set rest on bearing blocks 41 and 41a of complementary shape made in the bottom of the groove.

The frame 12 is additionally provided with a stop 42 carried by the internal surface of the internal wall 24 of the peripheral border. This stop preferably has a cross-section in the shape of a V open towards the inside of the frame and receives a projection 43 of complementary shape carried by the internal surface of the cover 14. The cooperation of this projection 43 and the stop 42, associated with the particular nature in which the cover bears on the frame 12, guarantees the cover 14 four-point bearing stability when it is subjected to the action of a vertical load, and does so whatever the point of application of the load on the cover. Any wobbling phenomenon of the cover is thus prevented, thereby avoiding the banging noises.

Figure 5:
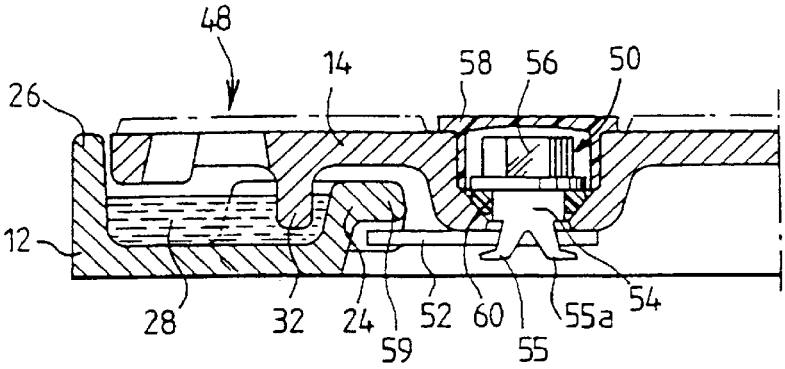
FIG. 5 is an enlarged view of a detail of the covering element of the device illustrated in FIG. 1.

The bottom of the groove 28 is filled with water so as to form an odour trap, in conjunction with the lip engaged in the groove, as shown in FIG. 5.

Figure 3:
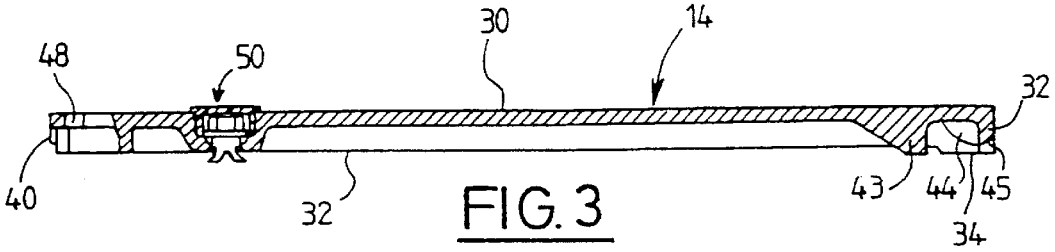
FIG. 3 is a sectional view along the line III—III of the covering element of the device of FIG. 1.

Referring in particular to FIG. 3, it can be seen that, according to the invention, the cover 14 is equipped with ramps, such as 44, having a sagittal section in the shape of a sector of a disc and extending between the internal surface of the lip 32 and the peripheral zone of the internal surface 30 of the cover.

These ramps are positioned on a single side of the cover 14 and constitute a means for guiding the cover 14, translationally and rotationally, during the displacement of the latter with respect to the frame under the action of a force exerted in a zone opposite the ramps 44. They are provided in sufficient number to allow effective guidance of the cover, while limiting friction. For example, the cover 14 is equipped with two ramps 44. The ramps 44 are arranged on the side of the cover where the plane bearing blocks 34 and 36 are situated.

During the mounting of the cover or the demounting thereof, the ramps 44 bear on the end edge of the internal wall 24 of the peripheral border of the frame, allowing the cover either to slide on the frame, during a translational movement, or to pivot about an axis of rotation coplanar with the frame, during a rotational movement.

Furthermore, the lower end of the lip 32 of the cover 14 is provided with a chamfer 45 extending along the side of the lip carrying the ramps 44. This chamfer is intended to avoid total overturning of the cover in the direction of opening by providing for stabilization of the cover in the open position in which it forms an opening angle greater than approximately 100° with respect to the general plane of the frame.

With the aim of facilitating the grasping of the cover 14, the latter is equipped with a grasping means 48 provided in the vicinity of the side of the cover situated opposite the ramps 44.

For example, it is produced in the course of casting of the cover 14 in the form of a through-orifice 48 which may be obtained by direct demoulding. The costly use of a core is thus unnecessary. In this case, as shown in FIG. 1, the peripheral lip 32 and the groove 28 advantageously exhibit an offset in this zone so that the orifice is placed outside the lip, so as to ensure the tightness to odours, in the event of use in a footway manhole.

The grasping means 48 may also be produced in the form of a blind hole, for example by coring, made in the external surface of the cover.

Finally, the cover is completed by a locking member 50, which can be seen in FIG. 5, situated opposite the ramps 44, allowing the cover 14 to be locked on the frame 12.

It can be seen in this figure that, for example, the lock 50 comprises a locking bar 52 secured to a pivoting rod 54 passing through the cover 14 by folding back two end limbs 55 and 55*a* of this rod against the lower face of the bar.

The pivoting rod 54 is equipped with a head 56 shaped so as to be able to be displaced angularly by means of a tool.

Preferably, the head 56 is capped by a protective plug 58.

A toroidal seal 60 may be interposed between the head 56 and the cover 14 so as to ensure tightness to odours and to constitute a brake avoiding accidental unlocking of the lock.

In the locked position, the bar 52 engages beneath a stop 59 of the frame integral with the inner wall 24 of the latter.

With reference to FIGS. 6 to 10, the operation for mounting the cover 14 on the frame 12 will be described.

Figure 6:
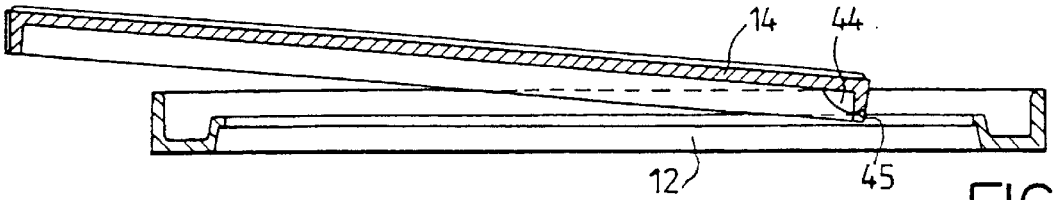
FIGS. 6 to 10 show schematically the operation for mounting the covering element on the frame.
Figure 7:
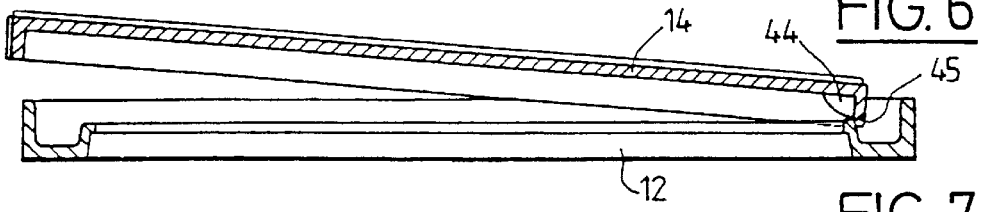

This operation is performed, from the position shown in FIG. 6, in which the cover rests by the side comprising the ramps 44 on the frame 12, by exerting a thrust on the cover tending to cause a translation of the latter with respect to the frame until the lip reaches the groove (FIG. 7).

Figure 8:
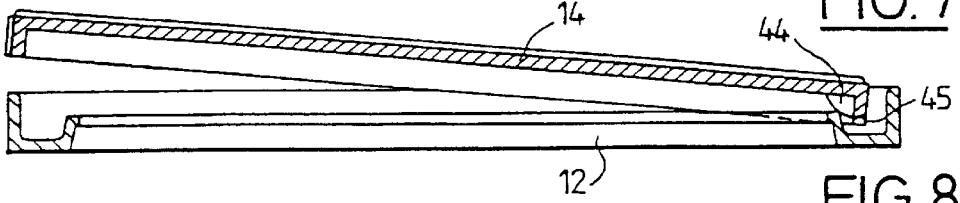
Figure 9:
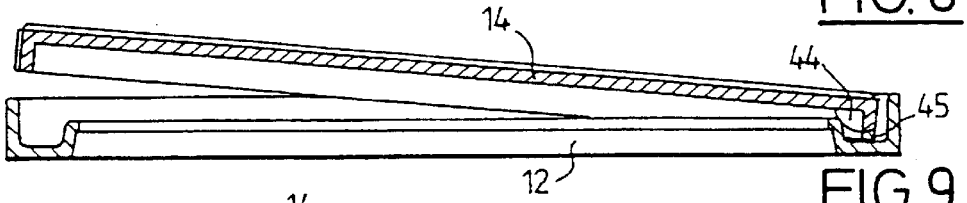
Figure 10:
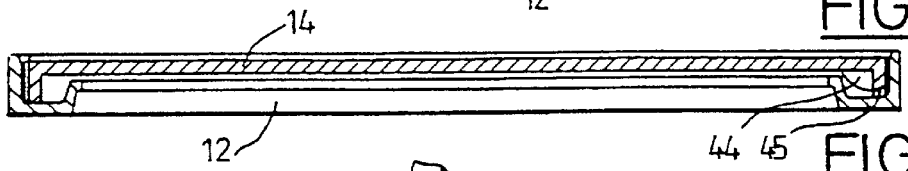

A subsequent thrust causes the engagement of the peripheral lip in the groove (FIGS. 8 and 9).

In this position, the projection 43 carried by the cover bears against the stop 42.

It can be seen in FIGS. 8 and 9 that, in the course of the engagement of the lip in the groove, the ramps 44 provide for the bearing and sliding of the cover on the free end edge of the internal wall 24 of the groove, thus allowing translation of the cover with less effort.

At the conclusion of this displacement, the peripheral lip is completely engaged in the groove.

In order to remove the cover, the reverse operations have to be performed.

Thus, it is necessary to exert a traction on the grasping means 48, that is to say a force exerted upwards, so as to disengage the lip from the groove in the zone opposite the ramps 44, in this case again using the bearing of the ramps 44 on the free end edge of the internal wall of the groove in order to translate the cover.

Figure 11:
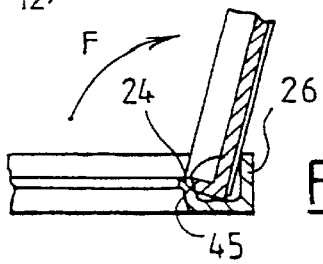
FIG. 11 is a view illustrating the rotational displacement of the covering element with respect to the frame from the closed position to the open position of the device.

In order to open the cover, as shown in FIG. 11, it is necessary to exert a traction on the cover 14 so as to cause a rotational movement of the cover in the direction of the arrow F about a horizontal axis of rotation extending in the groove.

It will be noted that in the course of this displacement, the ramps likewise bear against the end edge of the inner wall 24 of the groove, allowing rotational guidance of the cover.

It will be noted furthermore that the ramps 44 likewise provide for guidance of the cover during its rotation in the direction of closure, and do so by bearing, in this case too, against the end edge of the internal wall of the groove, providing relief for the operator manipulating the cover, in this case as well.

In addition, as can be seen in FIG. 11, the cover 14 is stabilized in the open position, in which it forms an opening angle greater than approximately 100° with respect to the general plane of the frame 12, on the one hand, by its outer surface which bears against the external wall 26 of the frame and, on the other hand, by the chamfer 45 which butts against the external surface of the inner wall 24 of the peripheral border of the frame.

Complete overturning of the cover in the direction of opening is thus avoided.

It will appreciated therefore that the invention which has just been described, which uses ramps in the shape of a sector of a disc in order to guide the covering element in the course of its displacement, allows manipulation of the latter either translationally, for the putting into place and removal thereof, or rotationally in the direction of opening and closure. These operations are performed easily, in that it is not necessary to lift the entire covering element.

What is claimed is:

1. A highway device, comprising:

a frame and a covering element for covering the frame, the frame includes an upstanding peripheral border with two walls delimiting a groove, and the covering element is equipped with a projecting peripheral lip which engages the groove in a frame-covering position, wherein the covering element further includes at least one ramp extending between the lip and an internal surface of the covering element, the at least one ramp being intended to bear on an end edge of the peripheral border of the frame and being operative to guide the covering element, so as to slide and rotate, when the covering element moves in relation to the frame, under an action of a force exerted on the covering element in a zone opposite the at least one ramp, and wherein the at least one ramp is provided on only one side of the covering element.

2. The device according to claim 1, wherein the at least one ramp has a sagittal section in a shape of a sector of a disc.

3. The device according to claim 1, wherein a free end edge of the lip comprises a chamfer constituting a stop for limiting a rotation of the covering element in a direction of opening, in conjunction with a free end zone of an external one of the two walls of the frame, on which an external surface of the covering element butts.

4. The device according to claim 1, wherein the covering element is equipped with grasping means situated opposite the at least one ramp.

5. The device according to claim 4, wherein the grasping means comprise a cutout formed in the external surface of the covering element.

6. The device according to claim 4, wherein the grasping means comprise a through-orifice formed in a wall of the covering element in a zone situated between a border of the covering element and the lip.

7. The device according to claim 6, wherein the lip forms an offset in a zone of said through-orifice.

8. The device according to claim 1, further including a lock for locking the covering element in a closed position, on the frame.

9. The device according to claim 8, wherein the lock includes a pivoting rod secured to a locking bar by means of two end limbs capable of being folded back, the bar being intended to be inserted beneath a stop of the frame.

10. The device according to claim 9, further including a seal interposed between the lock and the covering element.

11. The device according to claim 1, wherein the groove is filled with water and forms, in conjunction with the lip of the covering element, an odour trap.

12. The device according to claim 1, wherein the frame includes, at its base, at least one laterally projecting relief, the lower face of which is provided with a series of ribs for anchoring the device in an embedding material.

13. The device according to claim 1, wherein the frame includes anchoring ribs made in a median part of each side of the frame, the ribs being adapted to oppose bending of the frame.

14. A covering element for closing an inspection shaft or capping a drainage shaft, comprising:

a projecting peripheral lip intended to engage in a groove of a support frame, the groove being delimited by a peripheral border of the frame with two walls, wherein the covering element includes at least one ramp extending between the lip and an internal surface of the covering element and being intended to bear on an end edge of the peripheral border of the frame and being operative to guide the covering element, so as to slide and rotate, when the covering element moves in relation to the frame under an action of a force exerted on the element in a zone opposite the at least one ramp, and wherein the at least one ramp is provided on only one side of the covering element.

* * * * *